United States Patent [19]

Ferrari et al.

[11] 4,303,491

[45] Dec. 1, 1981

[54] APPARATUS FOR CLEANING THE BOTTOM OF ELECTROLYTIC MERCURY CATHODE CELLS

[75] Inventors: Giovanni Ferrari, Agnadello; Giuseppe Villa, Venezia-Mestre, both of Italy

[73] Assignee: Montedison S.p.A., Milan, Italy

[21] Appl. No.: 123,942

[22] Filed: Feb. 22, 1980

[30] Foreign Application Priority Data

Feb. 27, 1979 [IT] Italy ..... 20552 A/79

[51] Int. Cl.[3] ..... C25B 9/00; C25B 1/40

[52] U.S. Cl. ..... 204/279; 204/220; 204/250

[58] Field of Search ..... 204/219–220, 204/250, 99, 279

[56] References Cited

U.S. PATENT DOCUMENTS 712,218 10/1902 Truesdell ..... 204/219
3,840,453 10/1974 Cooper et al. ..... 204/219 X

FOREIGN PATENT DOCUMENTS 49-98798 9/1974 Japan ..... 204/99
51-41040 11/1976 Japan ..... 204/99
297391 10/1971 U.S.S.R. ..... 204/250

*Primary Examiner*—Donald R. Valentine
*Attorney, Agent, or Firm*—Stevens, Davis, Miller & Mosher

[57] ABSTRACT

An apparatus is disclosed for cleaning the bottom of mercury cathode electrolytic cells or the like, usable in closed cells which are cut off from the power supply and maintained under suction, characterized in that said apparatus consists essentially of a plate or strap that is displaceable along the bottom of the cell, and having an overall length substantially corresponding to the width of the cell-bottom to be cleaned, said strap normally resting on or near the bottom of the cell, and means for moving said strap along the bottom of the cell to scrape or dislodge mercury sludge and other residues that have accumulated during the operation of the cell. The means for moving the strap along the bottom of the cell may be manually actuated from outside the cell or they may be actuated by motor means situated outside the cell.

8 Claims, 6 Drawing Figures

APPARATUS FOR CLEANING THE BOTTOM OF ELECTROLYTIC MERCURY CATHODE CELLS

The present invention relates to apparatus suitable for carrying out the periodic cleaning of electrolytic mercury cathode cells or the like, without the necessity of opening the cells themselves.

It is well known that for its correct operation the mercury cathode electrolytic cell requires a periodic cleaning which involves the stopping of the cell, its emptying, its opening, and finally the removal, by direct intervention of the operators, of the "mercury sludge" and of all other deposits of various natures that, resting on the bottom of the cell, hinder the regular flow of the mercury.

The frequency of such a required cleaning varies according to the constructional characteristics of the cell, its state of preservation, and its operational conditions.

Moreover, between one cleaning operation and the next, a certain number of periodic "washings" with brine in the closed cell is employed, said washings also requiring the stopping of the cell.

The cleaning of the cell with its attendant opening, because of the required procedures and times, involves in practice the following main disadvantages: a heavy pollution of the environment by the mercury, a high loss of production, and a considerable use of labor.

Thus, a main object of this invention is that of providing an apparatus or equipment for cleaning the bottom of electrolytic cells, in particular cells having mercury cathodes, and adapted to achieve an effective cleaning without requiring the opening of the cells and, thus, without polluting effects upon the environment or work surroundings.

Still another object of this invention is that of providing an apparatus of the above type that is especially simple, easy to operate from outside the cell, and such that when not in use it may remain in place without interfering with the regular or normal working of the cell itself.

These, and still other objects that will more clearly appear from the detailed description that follows, are attained in practice by an apparatus for cleaning the bottom of electrolytic cells, particularly those having a mercury cathode, and usable with closed cell, without any brine and with lifted anode packs, said apparatus consisting or consisting essentially, according to this invention, of a plate or metal strap consisting of at least two crop-ends connected to each other by a hinge or the like, and of a total length substantially corresponding to the width of the bottom of the cell to be cleaned, said strap being placed on the bottom of the cell and connected to bar-like elements, preferably rigid, protruding beyond the inlet head of the cell and connectable through fast connecting means (i.e., "quick-disconnect" means) with other rigid elements so as to form rafters or struts maneuverable from outside the cell itself, said strap, shiftable on the bottom of the cell, being maintained in a resting position inside the inlet head of the cell and spaced from the bottom itself by means of spacers of electrically insulated material spaced from each other to allow the regular flow of the brine when the cell is in operation.

More particularly, said metal strap is so shaped as to have a substantially trapezoidal transversal cross-section or a wedge-like section, and is made of metal and at least partly of iron and of a composition chemically resistant to the cell fluids.

This invention, in a preferred embodiment, will now be described in more detail with reference to the attached drawings which are given for purely illustrative and not limiting purposes, and in which:

FIG. 4 is a transverse cross-section of the element represented in FIG. 3; while

Figure 1:
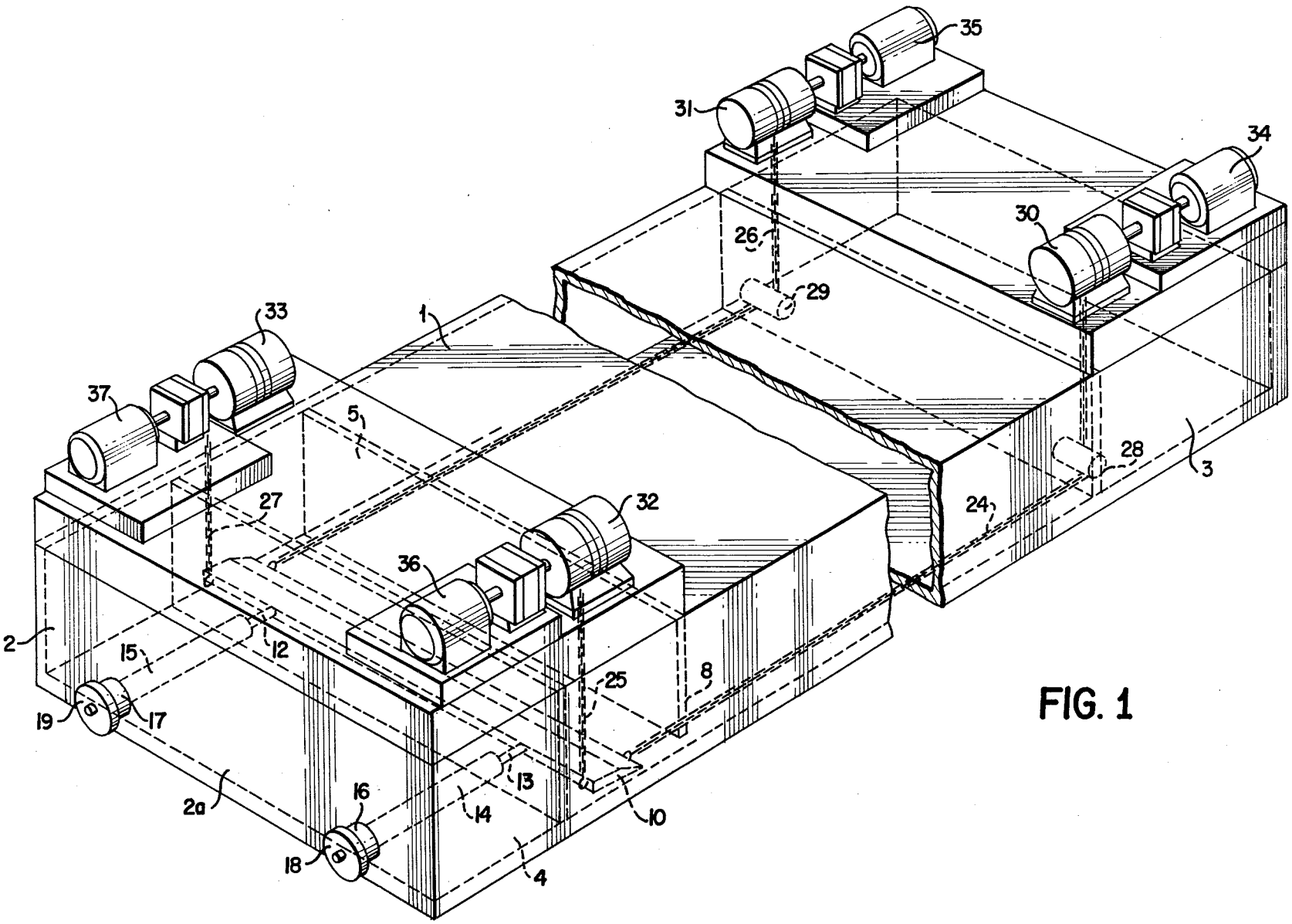
FIG. 1 is a schematic perspective view of the main elements of a chlorine-soda electrolytic mercury-cathode cell incorporating the device of this invention.
Figure 2:
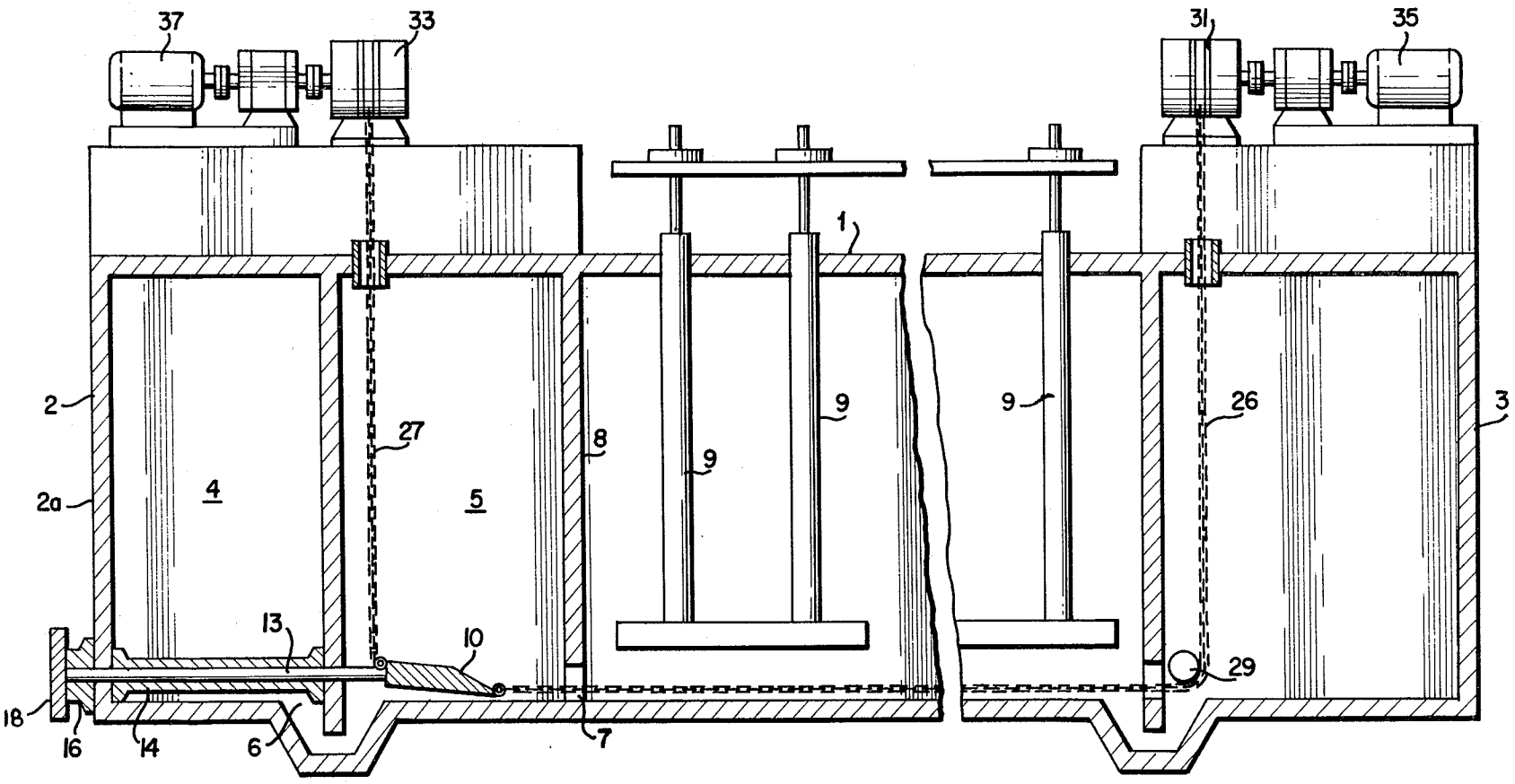
FIG. 2 is a schematic longitudinal cross-section of the cell of FIG. 1, with mounted anode packages, including more details and showing the cleaning device according to the present invention.

With reference to these figures, and in particular as shown in FIGS. 1 and 2, an electrolytic mercury amalgam cell for the production of chlorine and soda in general consists essentially of a tank or cell 1 with an inlet head 2 for the inflow of brine and an outlet head 3. The inlet head 2 is, as well known, subdivided into two compartments 4 and 5 intercommunicating with each other through an aperture or channel 6 on the bottom. Into compartment 4 is introduced the mercury, while into compartment 5 is introduced the brine, both by conventional means not shown. The brine passes into the cell 1 through an aperture or channel 7 provided at or near the bottom level of the cell in the separating wall 8 of inlet head 2.

In cell 1 are arranged the conventional anode packages 9 whose distance from the bottom of the cell is adjustable by any of various well known methods.

Figure 3:
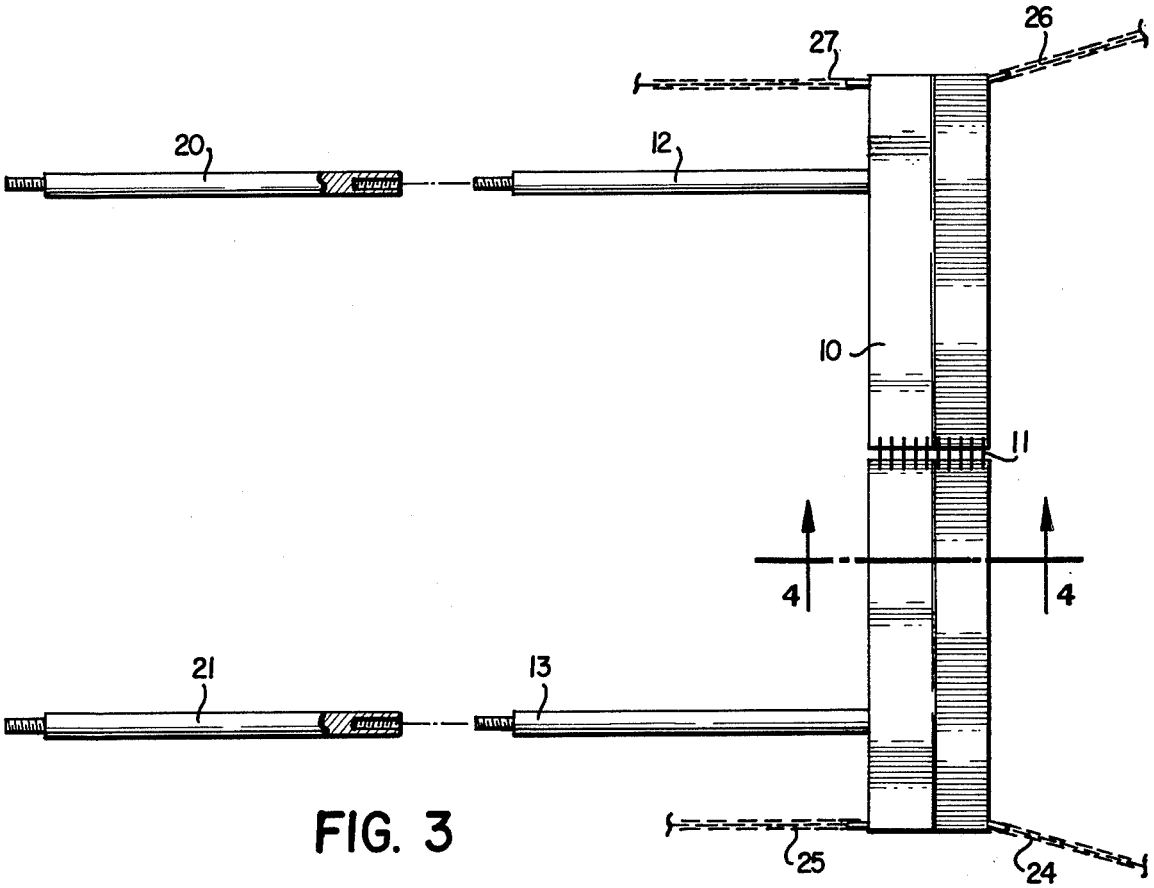
FIG. 3 is a schematic plan view of the main cleaning element of the apparatus of this invention.

The apparatus of this invention, and suitable for the cleaning of the cell bottom with the closed cell at rest, consists substantially of a strap or plate 10, preferably made of two halves connected to each other through hinge 11 (FIG. 3) and of a total length that corresponds substantially to the width of the inside of the cell 1.

The hinge 11 allows the use of a strap or plate 10 which is not rigid but formed by the two straps, hinged together by hinge 11, in order to provide a better fitting or adaptation of all the plate surface to the bottom of the cell which bottom, in certain cases, is not always perfectly flat, that is the bottom not always having a level surface.

Figure 4:
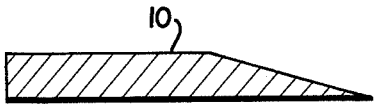

The strap 10 has a substantially trapezoidal or wedge-like transversal cross-section (FIG. 4), with a chamfered leading edge so as to facilitate, during its shifting or movement along the bottom of the cell from head 2 to the opposite head 3, the detachment (by a scraping action) from the bottom itself of the "mercury sludge" and any other adhering deposits that normally accumulate thereon during the operation of such cells.

The strap 10 is preferably made of titanium or iron so as to become magnetized and, thus, be kept closely adjacent to or adhering to the bottom of the cell by reason of the heavy currents that pass through it.

To the strap 10 are integrally fixed two rigid elements 12–13, made of stainless (inox) steel or the like, whose length is at least equal to the length (in the longitudinal direction of the cell) of compartment 4 of inlet head 2 and which are inserted into tubular ducts 14–15 which latter are interposed between the two walls of compartment 4 and are suitably insulated. In this way, the two rigid elements 12–13 throughout are guided up to and through the outside of wall 2*a* (FIG. 2) of the compartment 4. Said tubular ducts 14–15, during operation of the cell, are sealed by blocks or bushings 16–17 adapted to retain and block the ends of the rigid elements 12–13 in the wall 2*a* of the cell. Onto these blocks 16–17 are screwed blind flanges 18–19 for insuring fluid tightness of the cell.

In order to bring about the traversing or movement of the strap 10 along the bottom of the cell, there are provided further rigid elements 20–21 (see FIG. 3) that are screwable onto the heads of rigid elements 12–13. These rigid elements 20–21 themselves may in their turn be extended with other similar rigid elements (not shown) so as to form struts of a sufficient length for displacing the cleaning strap 10 up to the opposite end of the cell. These struts are controlled or actuated manually by the operators from the outside of the cell.

Figure 5:
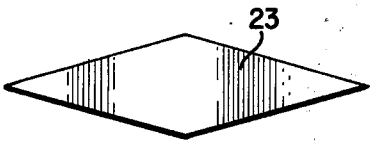
FIGS. 5 and 5*a* show in plan view and in cross-section, respectively, a detail of the apparatus of the invention.
Figure 5A:
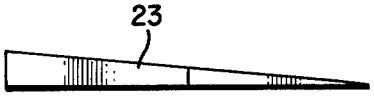

Strap 10, moreover, is of such a thickness as will allow it to pass through the rectangular port or aperture 7 provided in the base or bottom part of wall 8 of compartment 5, and, in resting position, inside compartment 5. The strap 10, moreover, is kept raised from the bottom of the cell by supporting elements 23 which are equally spaced under the strap and which are of a quadrangular shape (see FIGS. 5 and 5*a*). These supporting elements 23 are made of an electrically insulating material and are also corrosion-resistant, for instance they may be made of "ebonite" or the like.

The cleaning operations of a cell are carried out in the following way:

The cell is cut off from the electric power supply and is connected with a conventional chlorine separating plant (not shown) which will keep the cell under suction.

After shutting down the brine-feeding valve after the electrical power cut-off, for the replacement of the chlorinated brine contained in it, part of the brine is discharged into a recovery tank (not shown).

By suitable means for adjusting the interelectrode distances, as conventionally provided in such cells, anodes 9 are lifted up out of the way to avoid that during the cleaning operation they should come into contact with the cleaning device arranged inside the cell and with the loosened and displaced mercury slurry or sludge.

Thereupon the circulation of the mercury is stopped and flanges 18–19 are removed from the front wall of the cell, as well as the mounting blocks 16–17 of the device that were arranged inside the cell itself. Now rigid elements 20–21 are screwed or otherwise connected (on the inlet side of the cell head) with the rigid elements 12–13. Successively further couples of additional rigid elements 20–21 are added by progressively inserting them into the cell as required, thus moving the cleaning strap 10 along the bottom of the cell until it reaches the opposite or outlet head 3 of the cell.

Once the cleaning operation has been completed (that is, after one complete forward traverse of blade 10 from left to right as shown in FIG. 2) this latter is retracted into compartment 5 by the operators. The rigid elements 20–21 are then disassembled by the operators, carrying out the inverse operation of that carried out for their introduction into the cell, although the cell itself is completely closed and, as well known, is located very near to other cells in a large industrial installation.

After having brought back the strap or blade 10 into the inlet head 2 of the cell, the mercury slurry or sludge that has been pushed by the blade 10 into the outlet head 3 is removed by means of a suction pump (in a well known manner) acting through the upper cover of the outlet head 3 or through the rear wall of the same head 3, e.g., via conduit 3' as shown in FIG. 1. Thereupon mercury is made to circulate in the cell for a few minutes, in consequence of which the other deposits and incrustations already loosened from the bottom of the cell are dragged into the outlet head 3 of the cell from which they are removed by the operators in the usual way.

It is sufficient to carry out this procedure just one single time in order to obtain a perfect cleaning of the bottom of the cell.

After the above described operations, the cell is discharged of the brine contained in it via a conventional outlet (not shown).

Now blocks 16–17 are again mounted on the inlet head of the cell and thereafter are re-mounted the sealing flanges 18–19. After this, the freshly cleaned cell may again be placed back into normal operation.

The advantages offered by this procedure and by the device described above are considerable. In fact, in comparison with the traditional cleaning systems with fully opened cells, the time necessary for carrying out the cleaning operation is reduced by a factor of about ten. Thus there is achieved a very advantageous heavy reduction in the loss of production from any given cell.

Besides this, only two operators are required for the cleaning of each cell, thus effecting a very significant decrease in labor cost chargeable to the cell operation. Moreover, and perhaps even more important, the operators will be working under far better environmental conditions in comparison with those that occur in the conventional cleaning of fully open cells. In fact, the present invention avoids the diffusion of chlorine and mercury vapors into the environment, given that the cell remains completely closed and under suction during the entire cleaning operation. Moreover, the temperatures in the rooms in which the operators work are considerably lower than those where the cleaning is carried out in the conventional manner with the cells fully open.

It has been found in practice that it is sufficient to clean the cells with the device of the invention at time intervals of even many months while still maintaining excellent operational conditions (in particular only a limited formation of hydrogen in the cell and just a permissible percentage of sodium in the amalgam).

According to another embodiment also falling within the scope of this invention, blade 10 may be displaced along the bottom of the cell by motorized means. To this end (see FIGS. 1–2), to the strap blade 10 are connected two pairs of chains 24–25 and 26–27, made of a suitable material conventionally resistant to the type of corrosion encountered in the cell, which chains, by means of transmission wheels 28, 29, etc., are wound up on drums or pulleys 30–31 and 32–33 driven by reversible motor-reduction gears 34–35–36–37. By this means and with a suitable programming of the action of the motors and of corresponding conventional limit switches (not shown), it is possible to displace the strap 10 in both directions, thereby carrying out mechanically the same operations carried out by the operators manually as just described. It should be noted that for the "return cycle" of the scraper bar 10 in this "motorized" embodiment, there are included at the left end of compartment 5 two other transmission wheels 28' and 29' for the chains 26 and 27 that are identical in arrangement and function to elements 28 and 29 as shown at the right end of compartment 5.

It is clear that to the various described embodiments of this invention there may be introduced modifications and changes or equivalent variations from the functional and structural point of view, without falling outside the scope of the invention itself. Thus, for instance, the shape and the number of parts forming the strap 10 of the cleaning device may be varied just as may be varied the connection or coupling of the straps themselves. Also the struts by which the strap is displaced manually on the bottom of the cell may be realized in different ways, provided only that they are readily introducible and extractable into and removable from the cells without having to open the cells.

What is claimed is:

1. Apparatus for cleaning the bottom of a mercury cathode electrolytic cell, by displacing the mercury sludge along said bottom while said cell is cut off from the power supply and maintained under suction, said apparatus comprising:

(a) a metal plate displaceable along said bottom and also capable of assuming a resting position within the inlet head of said cell during operation of said cell, said plate being composed of at least two consecutively arranged sections, each of said sections being connected to its neighboring section via hinge means, so that the combined length of said sections constitutes the length of said plate and is substantially coextensive with the width of said bottom;

(b) at least two rigid rods for pushing said plate along said bottom, each of said rods having one end connected to said plate and the other end projecting beyond the inlet head of and outside said cell, said other end adapted to be connected via quick-connection means to extension rods so as to form multiple-rod struts operable from outside the cell; and (c) at least two supporting elements of electrically insulated material capable of supporting said plate while in said resting position and of raising said plate above said bottom thereby allowing flow of mercury and of the brine during operation of said cell.

2. The apparatus of claim 1, wherein said metal plate is made of titanium with some iron.

3. The apparatus of claim 1 or 2, wherein said metal plate has a substantially trapezoidal transverse cross-section, with a rounded-off leading edge.

4. The apparatus of claim 1, wherein said supporting elements are wedge-like.

5. The apparatus of claim 4, wherein the wedge-like elements are made of "ebonite".

6. The apparatus of claim 1, wherein said struts are guided up to and through the outside of said inlet head inside tight ducts through the head and closed by blocks and removable flanges thereby maintaining fluid tightness within the cell.

7. The apparatus of claim 1, further comprising:

(d) chains adapted to control the displacement of said metal plate along said bottom; and (e) pulleys adapted to wind up the chains in either direction, said pulleys being driven by reversible motor reduction gears.

8. The apparatus of claim 7, further comprising:

(f) guiding wheels fixedly located near the cell bottom for guiding said chains, said wheels being adapted to convert an upward pull of said chains into a pull on said chains in a direction parallel to the cell bottom.

* * * * *